United States Patent [19]

Shoup, II

[11] Patent Number: 4,593,469

[45] Date of Patent: Jun. 10, 1986

[54] LARGE SCALE X-Y PLOTTING TABLE

[75] Inventor: Walter C. Shoup, II, Wyckoff, N.J.

[73] Assignee: Autographic Business Forms, Inc., Mahwah, N.J.

[21] Appl. No.: 730,937

[22] Filed: May 6, 1985

[51] Int. Cl.[4] ..... B65H 17/36

[52] U.S. Cl. ..... 33/1 M; 33/32 C; 33/503; 33/18.1; 33/32.3

[58] Field of Search ..... 33/1 M, 18 R, 32 C, 33/32 E, 32 F, 448, 127, 128, 132 R, 136, 503; 38/102.1, 102.7

[56] References Cited

U.S. PATENT DOCUMENTS 3,548,502 12/1970 Baldwin ..... 33/18 R
3,816,930 6/1974 Edenholm ..... 33/503
3,844,461 10/1974 Robinson et al. ..... 33/1 M
4,245,394 1/1981 Peterson ..... 33/430
4,512,079 4/1985 LeBlond ..... 33/1 M

*Primary Examiner*—Willis Little

*Attorney, Agent, or Firm*—Hopgood, Calimafde, Kalil, Blaustein & Judlowe

[57] ABSTRACT

A large scale X-Y plotting table is provided with electro-pneumatically controlled clamping bars at opposite ends, with roller-formed troughs adjacent thereto for supporting supply and take-up rolls of sail cloth or the like. The clamping bars are coupled to foot operated switches for locking the bars alternatively in the clamping or releasing position. Index marks plotted at the fabric edge and an index line on the table, as well as a longitudinal fence, facilitate indexing the fabric between adjacent plotting fields corresponding to window fields of the associated CAD equipment.

7 Claims, 4 Drawing Figures

LARGE SCALE X-Y PLOTTING TABLE

BACKGROUND OF THE INVENTION

The present invention relates to large scale X-Y plotting tables for handling elongated pliable sheet material that exceeds lengthwise the plotting range of the table.

While the present invention is not limited thereto, it is particularly suited to pattern layout in the manufacture of marine sails. Large sails for sailing craft are fabricated by assembling a plurality of smaller panels. Such panels usually are of triangular configuration and of various sizes. The sail maker works with bolts of fabric, and a single panel may have a length of many yards. Therefore, there has been a need for a plotting device able to handle large rolls of cloth and apply pattern outlines thereto extending over a substantial continuous distance. Heretofore, no efficient mechanism has been available for accomplishing such large scale pattern layouts. Consequently, an object of the present invention is to satisfy such need.

In general, prior attempts at large tables, and even small plotting tables, have relied upon vacuum systems for securing the workpiece. The table tops are perforated or grooved to enable the development of negative pressure beneath the workpiece to cinch the latter to the former. While this method is acceptable with certain types of workpiece material and for certain purposes, it is disadvantageous when handling pliable material and the tool employed by the table mechanism is required to apply downward pressure during its traverse of the workpiece.

Therefore, another object of the present invention is to provide an arrangement for securing a workpiece to a plotting table or the like that does not require interruption of the continuity of the workpiece supporting surface of the table.

SUMMARY OF THE PRESENT INVENTION

In accordance with the present invention there is provided a large scale X-Y plotting table for handling elongated pliable sheet material that exceeds lengthwise the plotting range of the table and requires longitudinal indexing across the table between successive plots thereon for receiving in edge-to-edge registration successive adjacent contiguous plotting fields, comprising in combination a table structure for receiving said sheet material thereon, said structure having opposite side edges beyond which said material extends when placed in plot receiving position on said table, a plotting instrument mounted over said table for X-Y coordinate controlled motion, a clamp bar mounted on said table parallel and adjacent each of said side edges, said clamp bar having a length parallel to said side edges that exceeds the dimension of the widest sheet material to be used with said table, each said clamp bar being mounted for independently selective movement toward and away from the sheet material supporting surface of said table structure for selectively clamping said sheet material against said table structure, and operator controllable actuator means operatively coupled to each of said clamp bars for providing operator selectable actuation of each of said clamp bars into either clamping or releasing condition.

BRIEF DESCRIPTION OF THE DRAWINGS

The invention will be better understood after reading the following detailed description of the presently preferred embodiment thereof with reference to the appended drawings in which.

The same reference numerals are used throughout the drawings to designate the same or similar parts.

DETAILED DESCRIPTION OF THE PRESENTLY PREFERRED EMBODIMENT

In my copending application executed contemporaneously herewith and entitled "Computer Assisted Design and Electromechanical Operating System" there is described a method and apparatus that utilizes a CAD representation of a two-dimensional pattern to replicate the pattern in the displacement of an X-Y coordinate displaceable mechanism having separate drives for each of the X-Y components of displacement. When applied to sail making such system provides a convenient tool for laying out the patterns to be applied to the sail cloth. As explained in said application, the system has a windowing feature permitting the operator to break up a large job into smaller pieces that fit within the limits of the particular displaceable control mechanism being used. A plotting table is presented as an example. The table, of course, will have definite specifiable dimensions. However, using the system in my copending application, it is possible to plot a large design that exceeds the range of the particular plotting table. With the windowing feature, the plotting table can reproduce one section of the job at a time, with provision for repositioning the workpiece and continuing the plot until the job is completed. The system places reference marks along the edges of the workpiece at the boundaries corresponding to the boundaries of each window. Such reference marks are used to reposition the workpiece relative to index markings on the plotting table. The plotting table to be described hereinafter is particularly adapted to be used with the system described and claimed in my said copending application and the disclosure thereof is incorporated herein by reference.

Figure 1:
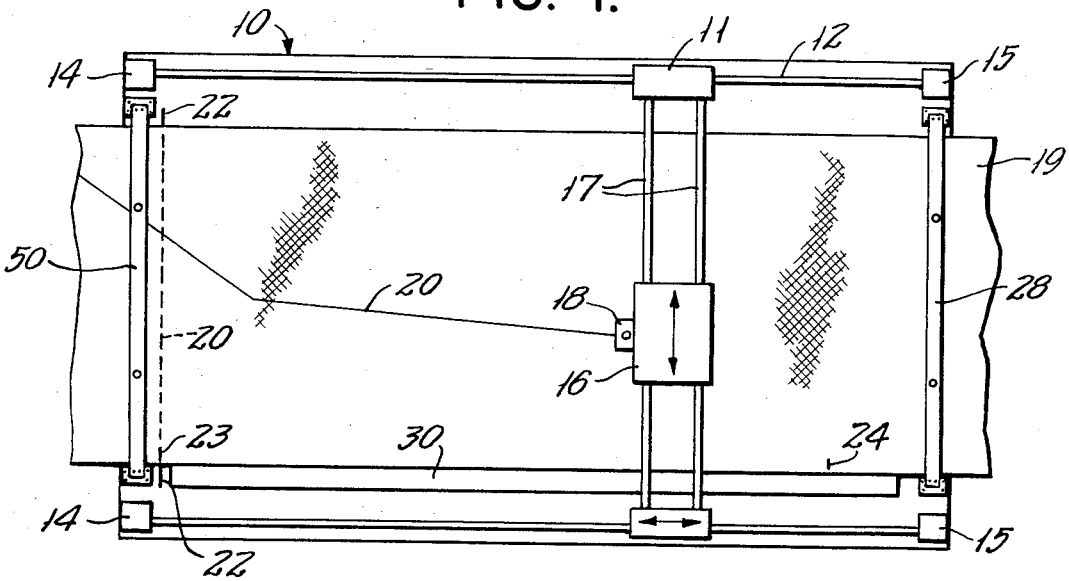
FIG. 1 is a top plan view somewhat diagrammatic of a plotting table constructed in accordance with the present invention.

Referring now to FIG. 1, there is illustrated quite diagrammatically the essential elements of a plotting table 10, having a gantry 11 riding along the X axis on side rails 12 and 13 between end stops 14 and 15, and a carriage 16 that rides on rails 17 along the gantry 11 to define the Y axis. The carriage 16 carries a suitable writing instrument in a toolhead 18.

The workpiece in the form of a length of cloth 19, longer than the X-axis dimension of the table 10, is in the process of having a long pattern line 20 drawn thereon. The portion of the line 20 to the left of the line 21, as viewed in the drawing, was drawn from a prior "window". The table 10 has a transverse index line 22 located at the position of the toolhead 18 when gantry 11 is against or in the vicinity of end stops 14. Since limit switches (not shown) must be provided to define the travel limits of the gantry, the gantry may not be physically in contact with a rigid stop when the toolhead is over the index line. A reference mark 23, previously applied at one edge of workpiece 19, is shown aligned over index line 22. Another reference mark, 24, is shown at the righthand limit of gantry travel. Normally, this mark would be applied when the gantry reaches its travel limit adjacent end stops 15.

As explained in my aforesaid copending application, it is necessary to reposition the workpiece 19 relative to the table 10 when the plot between the reference marks 23 and 24 has been completed. How this is accomplished will be explained subsequently after describing in greater detail the constructional features of the present plotting table. In any case the workpiece must be secured in position and this is accomplished by clamping bars 28 and 50 at opposite ends of the table, as shown.

Figure 2:
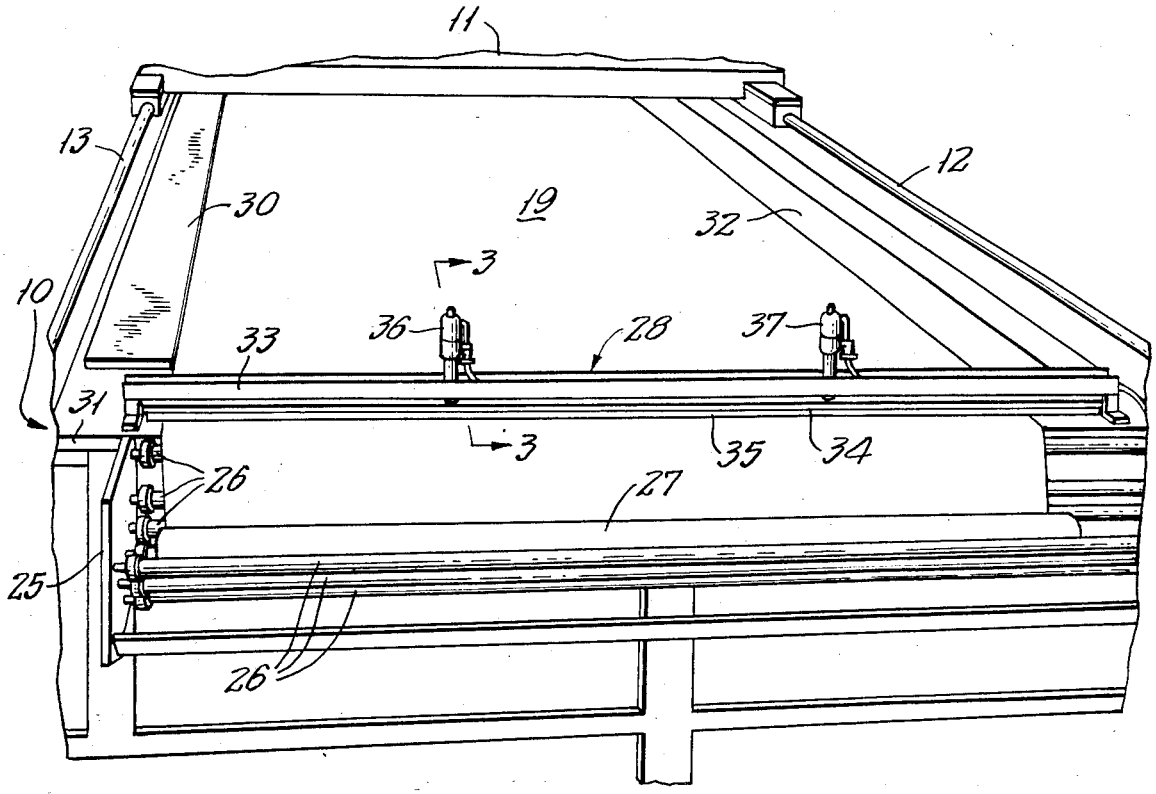
FIG. 2 is a perspective view of the table of FIG. 1 as seen from one end thereof.

Referring to FIG. 2, the plotting table is illustrated as seen from the supply side thereof. A trough-like structure 25 formed from a plurality of rollers 26 supports a roll 27 of fabric 19. The fabric is drawn out and extends under the clamp bar structure 28 across the table under the gantry, shown fragmentarily at 11, to be collected in a take-up roll supported at the far end by a structure essentially identical to the structure 25 seen in FIG. 2, but not otherwise shown. A fence 30 along one side of the table serves to locate and guide the edge of the fabric 19. The clamp bar 28 is shown mounted on the table 10 parallel and adjacent an edge 31. An identical clamp bar structure, shown only in FIG. 1, is mounted on the opposite end of the table beyond the gantry 11.

The clamp bar 28 and its mate 50 each have a length parallel to the side edge 31 of the table that exceeds the dimension of the widest sheet material to be used with such table. Each clamp bar is mounted for independently selective movement toward and away from the sheet material supporting surface 32 of the table 10 for selectively clamping the material 19 against the table structure. Operator controllable actuator means to be described hereinafter are operatively coupled to each of the clamp bars for providing operator selectable actuation of each of said clamp bars into either clamping or releasing condition.

Figure 3:
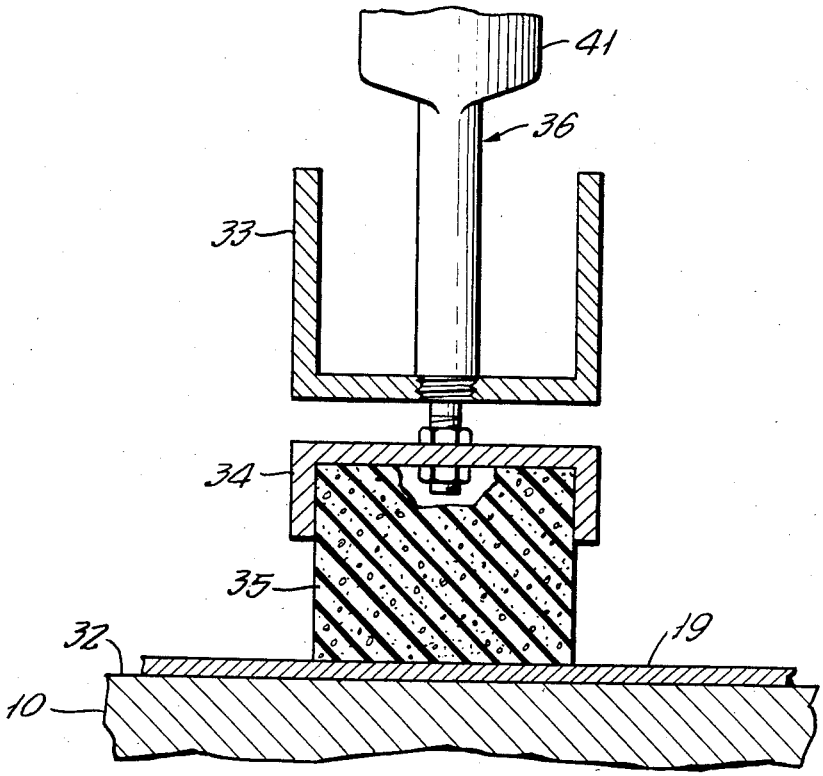
FIG. 3 is a fragmentary transverse sectional view taken along the line 3—3 in FIG. 2.

Referring to both FIGS. 2 and 3, it will be seen that the clamp bar 28 comprises a frame 33 supported in spaced parallel relationship above the table surface 32, and an elongated rigid carrier member 34 to which is secured a coextensive resilient pressure pad 35. The carrier member 34 is supported between the table surface 32 and the frame 33 joined to said frame by a pair of actuator members 36 and 37 for movement toward and away from the table surface.

Figure 4:
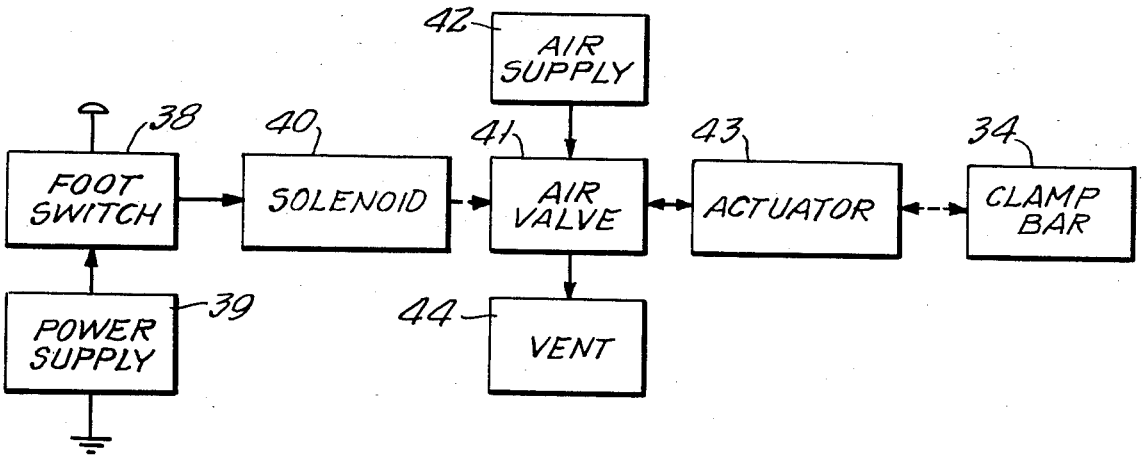
FIG. 4 is a block diagram illustrating the control system for actuating the clamp bars used in the table illustrated in FIGS. 1 to 3.

Referring to FIG. 4 the control system for the actuator members 36 and 37 is illustrated by way of a block diagram as consisting of a foot switch 38 controlling the application of current from a power supply 39 to a solenoid 40 which, in turn, mechanically manipulates an air valve 41 for controlling the supply of air from an air supply 42 to a pneumatic actuator 43. The actuator 43 is mechanically linked to the clamp bar carrier 34.

It is to be understood that the solenoid 40 in conjunction with the air valve 41 is constructed to have two operating conditions, one of which results in projection of the actuator 43 while the other causes retraction of the actuator 43. This operation is accomplished in any well known manner in cooperation with a vent 44. Any known electrically controlled pneumatic actuator assembly can be used for manipulating the clamp bar carrier 34. It should also be understood that the same construction is employed for clamp bar 50 at the opposite end of the table.

Referring to FIG. 3, the clamp bar assembly is shown in clamping position securing the fabric 19 against the table 10. The pressure pad 35 may be formed from any suitable material such as foam rubber or the like.

In the use of the table described with reference to the drawings, the roll of cloth 27 will be placed in the trough 25 and the operator will raise the clamp bar carrier 34 through manipulation of the associated foot switch 38. The fabric will then be withdrawn from the roll and extended along the table surface 32 alongside of the fence 30 under the gantry 11 and under the clamp bar assembly 50 also in raised condition. The operator then at the far side of the table, carefully positions the fabric against the fence 30 and lowers the clamp bar 50 into the clamping position. The operator then returns to the supply side of the table and pulls taut the fabric whereupon clamp bar assembly 28 is lowered to secure the fabric in place on the table surface 32. Now plotting can take place within the plotting area and the tick mark 24 near the supply side of the workpiece or fabric can be applied. Next, the fabric is released by raising both clamp bars 28 and 50 and the operator at the far side of the table as seen in FIG. 2 can draw the fabric toward that end of the table until the mark 24 comes into registration over the index line 22 on the table 10. Having established registration, the clamp bar 50 is lowered and the operator returns to the supply side of the table to pull the fabric taut and lower the clamp bar 28. The plotting procedure can then proceed within the new area.

In order to provide some insight into the size of the plotting table, one has been constructed with a plotting area measuring 60″×120″ and has been operated successfully.

Having described the present invention with reference to the presently preferred embodiment thereof, it is to be understood that various changes in construction can be incorporated without departing from the true spirit of the invention as defined in the appended claims.

What is claimed is:

1. A large scale X-Y plotting table for handling elongated pliable sheet material that exceeds lengthwise the plotting range of the table and requires longitudinal indexing across the table between successive plots thereon for receiving in edge-to-edge registration successive adjacent contiguous plotting fields, comprising in combination a table structure for receiving said sheet material thereon, said structure having opposite side edges beyond which said material extends when placed in plot receiving position on said table, a plotting instrument mounted over said table for X-Y coordinate controlled motion, a clamp bar mounted on said table parallel and adjacent each of said side edges, said clamp bar having a length parallel to said side edges that exceeds the dimension of the widest sheet material to be used with said table, each said clamp bar being mounted for independently selective movement toward and away from the sheet material supporting surface of said table structure for selectively clamping said sheet material against said table structure, and operator controllable actuator means operatively coupled to each of said clamp bars for providing operator selectable actuation of each of said clamp bars into either clamping or releasing condition.

2. A plotting table according to claim 1, characterized in that said actuator means is provided with an operator controllable switch for selecting said clamp bar conditions, said switch being constructed and arranged for actuation by the operator while the operator's hands are free for positioning the sheet material.

3. A plotting table according to claim 2, characterized in that said switch is constructed for foot operation.

4. A plotting table according to claim 3, characterized in that said actuator means comprises an electrically controlled pneumatic actuator.

5. A plotting table according to claim 1, characterized in that said actuator means comprises an electrically controlled pneumatic actuator.

6. A plotting table according to claim 2, characterized in that said actuator means comprises an electrically controlled pneumatic actuator.

7. A plotting table according to claim 1, characterized in that each said clamp bar comprises a frame supported in spaced parallel relationship above said table surface, an elongated rigid carrier member to which is secured a coextensive resilient pressure pad, said carrier member being supported between said table surface and said frame joined to said frame by said actuator means for movement toward and away from said table surface.

* * * * *